US009270044B2

(12) United States Patent
Hara

(10) Patent No.: US 9,270,044 B2
(45) Date of Patent: Feb. 23, 2016

(54) SUBSTRATE CONNECTOR

(71) Applicant: YAZAKI CORPORATION, Tokyo (JP)

(72) Inventor: Terufumi Hara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/488,822

(22) Filed: Sep. 17, 2014

(65) Prior Publication Data

US 2015/0004812 A1 Jan. 1, 2015

Related U.S. Application Data

(63) Continuation of application No. PCT/JP2013/061556, filed on Apr. 12, 2013.

(30) Foreign Application Priority Data

Apr. 19, 2012 (JP) ..... 2012-095807

(51) Int. Cl.

| | |
|---|---|
| ***H01R 13/24*** | (2006.01) |
| ***H01R 12/71*** | (2011.01) |
| ***H01R 13/629*** | (2006.01) |
| ***H01R 4/48*** | (2006.01) |

(52) U.S. Cl.

CPC ..... *H01R 13/2428* (2013.01); *H01R 4/489* (2013.01); *H01R 12/714* (2013.01); *H01R 13/62938* (2013.01); *H01R 13/2442* (2013.01)

(58) Field of Classification Search

CPC ..... H01R 12/714; H01R 13/2428

See application file for complete search history.

(56) References Cited

U.S. PATENT DOCUMENTS 3,209,308 A * 9/1965 Aquillon ..... H01R 12/714 439/289
3,365,694 A * 1/1968 Parker ..... H01R 12/592 439/353

(Continued)

FOREIGN PATENT DOCUMENTS

CH 675652 A5 10/1990
DE 100 17 319 A1 10/2001

(Continued)

OTHER PUBLICATIONS

International Search Report and Written Opinion of the International Search Report for PCT/JP2013/061556 dated Aug. 29, 2013.

(Continued)

*Primary Examiner* — Ross Gushi
(74) *Attorney, Agent, or Firm* — Kenealy Vaidya LLP

(57) ABSTRACT

There are provided in the substrate connector a connector main body that has a leading end face butted against the circuit board, thereby bringing leading end faces of terminal fitting, which are housed and retained in the connector main body, with contact point patterns on the circuit board, thereby butting; and a connector receiving member that is attached to the circuit board and that holds the leading end face of the connector main body butted against the surface of the circuit board. The terminal fitting is provided by spring pieces that impart predetermined contact pressure as a result of contact points, which contact the contact point patterns, experiencing elastic deformation upon contact with the corresponding contact point patterns.

4 Claims, 17 Drawing Sheets

(56) References Cited

U.S. PATENT DOCUMENTS 3,417,362 A * 12/1968 Reynolds ..... H01R 12/81 439/676
3,566,344 A 2/1971 Teagno et al.
3,633,152 A * 1/1972 Podmore ..... H01R 12/714 439/329
4,087,146 A * 5/1978 Hudson, Jr. ..... H01R 12/714 439/493
4,306,761 A * 12/1981 Ress, Jr. ..... H01R 13/26 439/862
4,778,404 A * 10/1988 Pass ..... H01R 13/2428 439/246
4,871,315 A * 10/1989 Noschese ..... H01R 12/79 439/329
4,948,379 A * 8/1990 Evans ..... H01R 12/79 439/329
5,015,197 A * 5/1991 Redmond ..... H01R 12/721 439/329
5,037,319 A * 8/1991 Hatagishi ..... H01R 13/4538 439/137
5,051,100 A * 9/1991 Kato ..... H01R 13/4538 439/137
5,230,636 A * 7/1993 Masuda ..... H01R 13/631 439/140
5,232,373 A * 8/1993 Sawada ..... H01R 13/641 439/140
5,277,603 A * 1/1994 Yamatani ..... H01R 13/4538 439/137
5,306,158 A * 4/1994 Endo ..... H01R 12/721 439/59
5,397,239 A * 3/1995 Zaderej ..... H05K 1/0278 174/254
5,399,101 A * 3/1995 Campbell ..... H01R 13/2464 439/482
5,411,399 A * 5/1995 Okuyama ..... H01R 12/79 439/595
5,489,216 A * 2/1996 Matsushita ..... H01R 12/82 439/260
5,540,599 A * 7/1996 Bishop ..... H01R 13/2428 439/289
5,573,415 A * 11/1996 Fujitani ..... H01R 12/87 439/260
5,632,638 A * 5/1997 Matsushita ..... H01R 12/721 439/260
5,647,774 A * 7/1997 Yamamoto ..... H01R 13/4361 439/140
5,647,778 A * 7/1997 Yamaguchi ..... H01R 13/436 439/595
5,675,888 A * 10/1997 Owen ..... H01R 43/205 29/829
5,676,562 A * 10/1997 Fukuda ..... H01R 12/79 439/329
5,746,628 A * 5/1998 Yamamoto ..... H01R 13/4362 439/595
5,924,879 A * 7/1999 Kameyama ..... H01R 13/2442 439/141
5,947,775 A * 9/1999 Yamamoto ..... H01R 13/17 439/752
5,975,946 A * 11/1999 Watanabe ..... H01R 13/193 439/557
6,019,625 A * 2/2000 Nimura ..... H01R 13/62905 439/259
6,059,595 A * 5/2000 Lacrouts-Cazenave H01R 13/05 439/289
6,132,224 A * 10/2000 Murakami ..... H05K 1/118 439/260
6,139,335 A * 10/2000 Kodama ..... H01R 12/592 439/140
6,183,269 B1 * 2/2001 Sarkissian ..... H01R 11/05 439/66
6,206,732 B1 * 3/2001 Fukuda ..... H01R 13/73 439/592
6,217,354 B1 * 4/2001 Fencl ..... H01R 13/62977 439/157
6,220,881 B1 * 4/2001 Murakami ..... H01R 12/721 439/262
6,224,388 B1 * 5/2001 Ahr ..... H05K 1/184 439/55
6,419,501 B1 * 7/2002 Okabe ..... H01R 12/79 439/77
6,491,552 B2 * 12/2002 Horikoshi ..... G06F 1/1616 361/785
6,494,781 B2 * 12/2002 Fujita ..... H01R 12/721 439/260
6,589,082 B2 * 7/2003 Harasawa ..... H01R 13/2442 439/595
6,655,983 B1 * 12/2003 Ishikawa ..... G01R 1/07314 324/755.01
6,773,283 B2 * 8/2004 Yoshimatsu ..... H01R 12/714 200/51.05
6,783,371 B2 * 8/2004 Self ..... H01R 4/027 439/493
6,971,929 B2 * 12/2005 Safai ..... H01R 13/22 439/852
7,066,756 B2 * 6/2006 Lange ..... H01R 12/7017 439/289
7,115,005 B2 * 10/2006 Zhu ..... H01R 13/2442 439/66
7,144,256 B2 * 12/2006 Pabst ..... H01R 12/88 439/67
7,153,173 B2 * 12/2006 Harasawa ..... H01R 13/2442 439/862
7,179,134 B2 * 2/2007 Harasawa ..... H01R 13/2442 439/752
7,354,318 B2 * 4/2008 Murakami ..... H01R 4/185 439/701
7,367,837 B2 * 5/2008 Pabst ..... H01R 12/592 439/452
7,481,682 B2 * 1/2009 Murakami ..... H01R 4/185 439/701
7,513,789 B2 * 4/2009 Sasaki ..... H01R 13/6272 439/352
7,549,884 B2 * 6/2009 Soubh ..... G01R 1/06733 439/289
7,563,118 B1 * 7/2009 McCauley ..... H01R 13/533 439/260
7,594,830 B2 * 9/2009 Murakami ..... H01R 4/185 439/701
7,607,952 B2 * 10/2009 Tai ..... H01R 12/57 439/700
7,654,847 B2 * 2/2010 Soubh ..... G01R 1/06733 29/743
7,918,670 B2 * 4/2011 Shmatovich ..... G01R 1/0416 439/67
8,696,372 B2 * 4/2014 Endo ..... H01R 12/721 439/260
8,845,349 B2 * 9/2014 Shindo ..... H01R 13/6315 439/247
8,876,537 B2 * 11/2014 Katsuse ..... H01R 13/506 439/701
8,936,474 B2 * 1/2015 Katsuse ..... H01R 13/6273 439/701
8,939,802 B2 * 1/2015 Hara ..... H01R 13/05 439/867
2002/0048975 A1 * 4/2002 Horikoshi ..... G06F 1/1616 439/78
2002/0076994 A1 * 6/2002 Harasawa ..... H01R 13/2442 439/752
2003/0211787 A1 * 11/2003 Harasawa ..... H01R 13/2442 439/862
2006/0040536 A1 2/2006 Putnam et al.
2006/0079102 A1 * 4/2006 DeLessert ..... H01R 12/714 439/65
2006/0290364 A1 * 12/2006 DeLessert ..... H01R 13/2428 324/755.05
2011/0053405 A1 3/2011 Kobayashi et al.
2013/0005161 A1 * 1/2013 Lee ..... H01R 12/716 439/76.2
2013/0237068 A1 * 9/2013 Katsuse ..... H01R 9/223 439/76.2
2014/0065854 A1 * 3/2014 Heinrich ..... H01R 12/7023 439/78

(56) References Cited

U.S. PATENT DOCUMENTS

| | | | | |
|---|---|---|---|---|
| 2014/0087572 | A1* | 3/2014 | Saur | H01R 12/515 439/81 |
| 2014/0113501 | A1* | 4/2014 | Schoenfeld | H01R 12/714 439/700 |
| 2015/0004812 | A1* | 1/2015 | Hara | H01R 12/714 439/76.1 |
| 2015/0072542 | A1* | 3/2015 | Hara | H01R 12/714 439/74 |
| 2015/0155645 | A1* | 6/2015 | Hara | H01R 12/714 439/345 |

FOREIGN PATENT DOCUMENTS

| | | | | |
|---|---|---|---|---|
| EP | 1 648 029 | A2 | 4/2006 | |
| JP | 54-167392 | U | 11/1979 | |
| JP | 10-504676 | A | 5/1998 | |
| JP | 2009-259442 | A | 11/2009 | |
| JP | 2011-70827 | A | 4/2011 | |
| WO | 94/11925 | A1 | 5/1994 | |
| WO | WO 9411925 | A1 * | 5/1994 | H01R 13/2428 |
| WO | 2009/129062 | A1 | 10/2009 | |
| WO | 2012/015074 | A1 | 2/2012 | |

OTHER PUBLICATIONS

Japanese Office Action for the related Japanese Patent Application No. 2012-095807 dated Nov. 4, 2015.

* cited by examiner

SUBSTRATE CONNECTOR

CROSS REFERENCE TO RELATED APPLICATIONS

This application is a continuation of PCT application No. PCT/JP13/061,556, which was filed on Apr. 12, 2013 based on Japanese Patent Application (No. 2012-095807) filed on Apr. 19, 2012, the contents of which are incorporated herein by reference.

BACKGROUND OF THE INVENTION

1. Field of the Invention

The present invention relates to a substrate connector for conductively connecting terminal fitting connected to a cable from an external device to contact point patterns that are arrayed at a predetermined array pitch on a circuit board.

2. Description of the Related Art

FIG. 17 illustrates an example of a related-art substrate connector. A substrate connector 100 is described in connection with PTL 1.

The substrate connector 100 has a connector housing 110, which is made from a resin, to be mounted on a circuit board 200 and a plurality of pieces of needle-shaped male terminal fitting 120 embedded in the connector housing 110.

One end 121 of the individual piece of the male terminal fitting 120 is situated in the connector housing 110. Another end 122 of the male terminal fitting 120 extends from a rear end of the connector housing 110 and is bent toward the circuit board 200 and subsequently inserted into the a through hole 201 opened in the circuit board 200.

The other end 122 of the male terminal fitting 120 inserted into the through hole 201 is soldered to a contact point pattern put on the through hole 201, to thus become conductively connected to the contact point pattern on the circuit board 200. The individual male terminal fitting 120 is soldered to the contact point pattern, whereby the substrate connector 100 is secured to the circuit board 200.

An equipment-side connector, though it is un-illustrated, connected to a cable from external device is fittingly connected to the substrate connector 100. The equipment-side connector is configured by housing and retaining pieces of female terminal fitting that are to be fitted, like mating, to the respective ends 121 of the pieces of male terminal fitting 120.

CITATION LIST

Patent Literature

[PTL 1] JP-A-2011-70827

Incidentally, there is possibility in that the above-mentioned substrate connector 100 requires laborious soldering work when the substrate connector 100 is mounted on the circuit board 200.

In order to conductively connect a cable from external device to the contact point patterns on the circuit board 200, it is necessary to fit the equipment-side connector to the substrate connector 100 and mate the pieces of terminal fitting retained in the respective connectors with each other. However, when the pieces of terminal fitting are mated with each other, there is a potential risk of the terminal fitting being damaged by a collision between the terminals or prying action.

SUMMARY OF THE INVENTION

The present invention has been implemented in view of above-described circumstance. And, an objective of the present invention is to provide with a substrate connector that obviates a necessity of laborious work for soldering a circuit board and a risk of inflicting damage on terminal fitting, which would otherwise be caused by a collision or prying action during mating operation, and that enables easy conductive connection of terminal fitting, which is connected to a cable from external device, with contact point patterns on the circuit board.

The objective of the present invention is accomplished by the following configurations.

(1) A substrate connector that conductively connects a terminal fitting connected to a cable from an external device with contact point patterns arrayed at a predetermined array pitch on one side of a circuit board, the connector comprising a connector main body that houses and retains pieces of the terminal fitting at an array pitch corresponding to the array pitch of the contact point patterns and having a leading end face but against a surface of the circuit board on which the contact point patterns are arrayed, so as to bring leading end faces of the pieces of the terminal fitting with the contact point patterns; and a connector receiving member that is attached to the circuit board and that holds the leading end face of the connector main body butted against the surface of the circuit board; wherein the terminal fitting is provided with a spring piece that imparts a predetermined contact pressure to the contact point patterns by a predetermined elastic deformation upon contact with the corresponding contact point patterns and served as contact points to be contacted with the contact point patterns, and the spring piece is formed integrally on the terminal main body by folding a strip-shaped plate piece continued from the one sidewall of the terminal main body such that a portion of the plate piece projects from the leading end of the terminal main body.

(2) The substrate connector defined in (1), wherein, when elastically deformed upon contact with the contact point patterns, the contact points of the terminal fitting are elastically displaced along a planar direction of the contact point patterns so as to slide over surfaces of the contact point patterns.

(3) The substrate connector defined in (1), wherein the spring piece is placed between a pair of sidewalls of the terminal fitting such that a portion of the spring piece projects from the leading end of the terminal main body; a leading end of the portion of the spring piece that projects from the leading end of the terminal main body is served as the contact point; and a portion of the spring piece situated in the terminal main body is served as a spring for elastically displacing the corresponding contact point in a direction opposite to a projecting direction.

(4) The substrate connector defined in (1), wherein the connector receiving member has a tubular section to which the connector main body fits and a boss provided projectingly on an exterior surface of the tubular section, and wherein the connector main body includes a fitting control lever attached so as to be turnable and a cam groove that is formed in the fitting control lever and that draws the boss in a fitting direction of the connector main body by turning action of the fitting control lever, so as to connect the connector main body to the connector receiving member.

In the configuration (1), a conductive connection of the terminal fitting connected to the cable from the external device with the contact point patterns on the circuit board is realized by connecting the connector main body to the connector receiving member on the circuit board and butting the leading end face of the connector main body against the surface of the circuit board, thereby bringing the leading end faces of the pieces of the terminal fitting retained by the connector main body into contact with the contact point patterns on the circuit board. Therefore, when the cable from the external device is conductively connected to the contact point patterns of the circuit board, laborious work for soldering the circuit board becomes unnecessary.

In addition, conductively connecting the terminal fitting connected to the cable from the external device with the contact point patterns on the circuit board is carried out by a mutual butt contact, and mating the pieces of terminal fitting to each other, which would otherwise cause a collision or prying during connection, is not performed. For these reasons, there is no potential risk of causing breakage of the terminal fitting, which might be caused by a collision or prying action during connection.

Accordingly, the terminal fitting connected to the cable from the external device can be easily brought into a conductive connection with the contact point patterns on the circuit board.

The terminal fitting is provided by the spring pieces that impart predetermined contact pressure to the contact point patterns as a result of the contact points, which contact the contact point patterns, experiencing predetermined elastic deformation upon contact with the corresponding contact point patterns. Therefore, a stable state of electrical connection can be assured without being affected by dimensional and assembly errors in the connector main body, and reliability of a connection between the contact point patterns and the terminal fitting can be improved.

In the configuration (2), when contacting the corresponding contact point patterns of the circuit board, the contact points of the terminal fitting slide over the surfaces of the respective contact point patterns in the course of elastic displacement, thereby performing wiping action effective for removing an oxide coating film from each of the contact surfaces of both the contact point patterns and the contact points. Therefore, a drop in electrical connection characteristic, which would otherwise be caused by the oxide coating film, can be prevented.

In the configuration (3), the terminal fitting having the contact points that are elastically displaced can be easily provided without involvement of an increase in the number of parts.

In the configuration (4), a connection of the connector main body with the connector receiving member can be easily implemented by turning operation of the fitting control lever, thereby making easy work for coupling the connector main body with the connector receiving member.

In the substrate connector of the present invention, a conductive connection of the terminal fitting connected to the cable from the external device with the contact point patterns on the circuit board is realized by connecting the connector main body to the connector receiving member on the circuit board and butting the leading end face of the connector main body against the surface of the circuit board, thereby bringing the leading end faces of the pieces of the terminal fitting retained by the connector main body into contact with the contact point patterns on the circuit board. Therefore, when the cable from the external device is conductively connected to the contact point patterns of the circuit board, laborious work for soldering the circuit board becomes unnecessary.

In addition, conductively connecting the terminal fitting connected to the cable from the external device with the contact point patterns on the circuit board is carried out by a mutual butt contact, and mating the pieces of terminal fitting to each other, which would otherwise cause a collision or prying during connection, is not performed. For these reasons, there is no potential risk of causing breakage of the terminal fitting, which might be caused by a collision or prying action during connection.

Accordingly, the terminal fitting connected to the cable from the external device can be easily brought into a conductive connection with the contact point patterns on the circuit board.

The terminal fitting is provided by the spring pieces that impart predetermined contact pressure to the contact point patterns as a result of the contact points, which contact the contact point patterns, experiencing predetermined elastic deformation upon contact with the corresponding contact point patterns. Therefore, a stable state of electrical connection can be assured without being affected by dimensional and assembly errors in the connector main body, and reliability of a connection between the contact point patterns and the terminal fitting can be improved.

The present invention has been briefly descried thus far. Details of the present invention will become more clear by thoroughly reading a mode for implementing the present invention to be described later (hereinafter called an "embodiment") by reference to the accompanying drawings.

DETAILED DESCRIPTION OF THE EXEMPLARY EMBODIMENTS

A preferred embodiment of a substrate connector of the present invention is hereunder described in detail by reference to the drawings.

Figure 1:
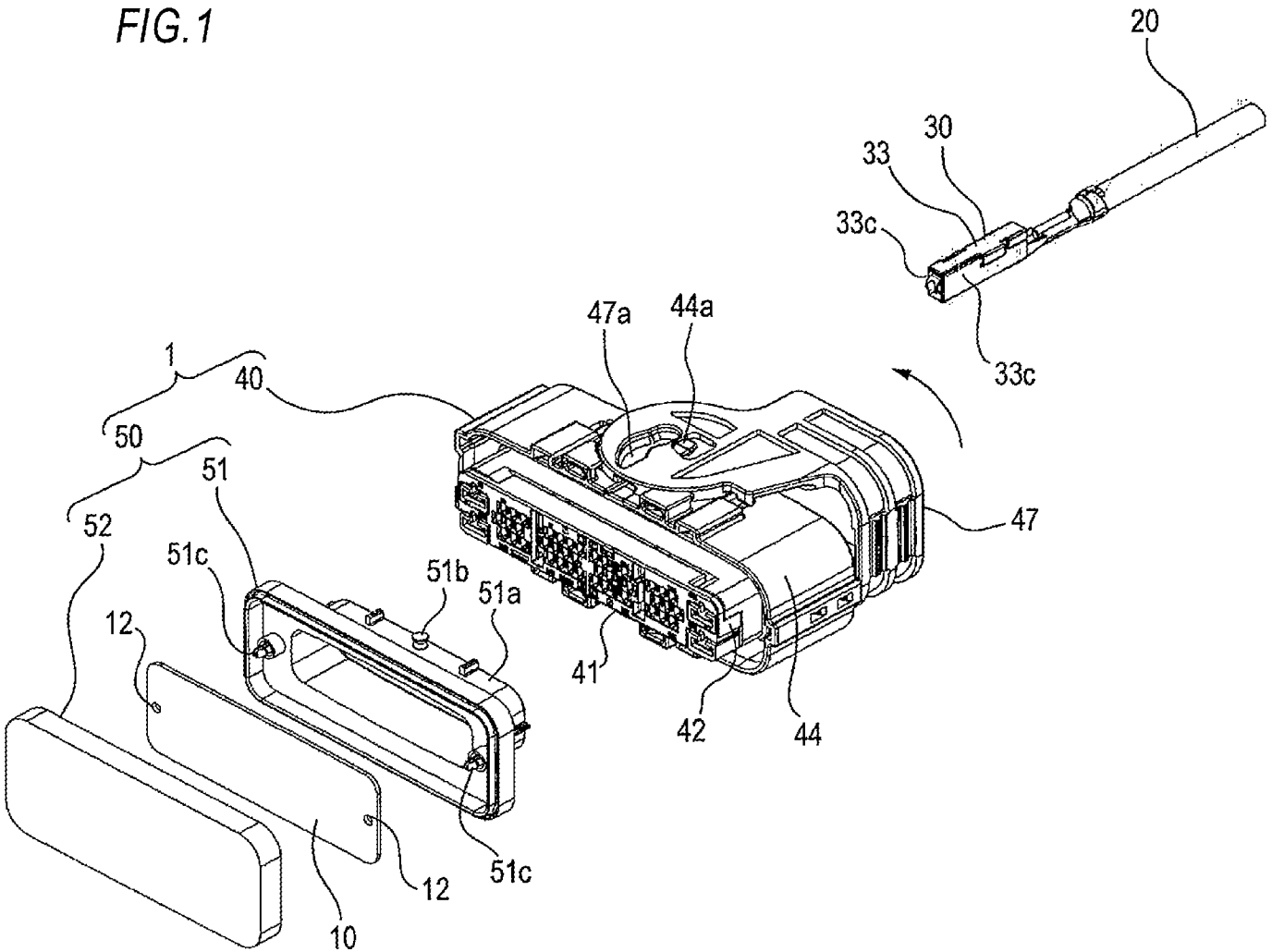
FIG. 1 is an exploded perspective view of an embodiment of a substrate connector of the present invention.
Figure 2:
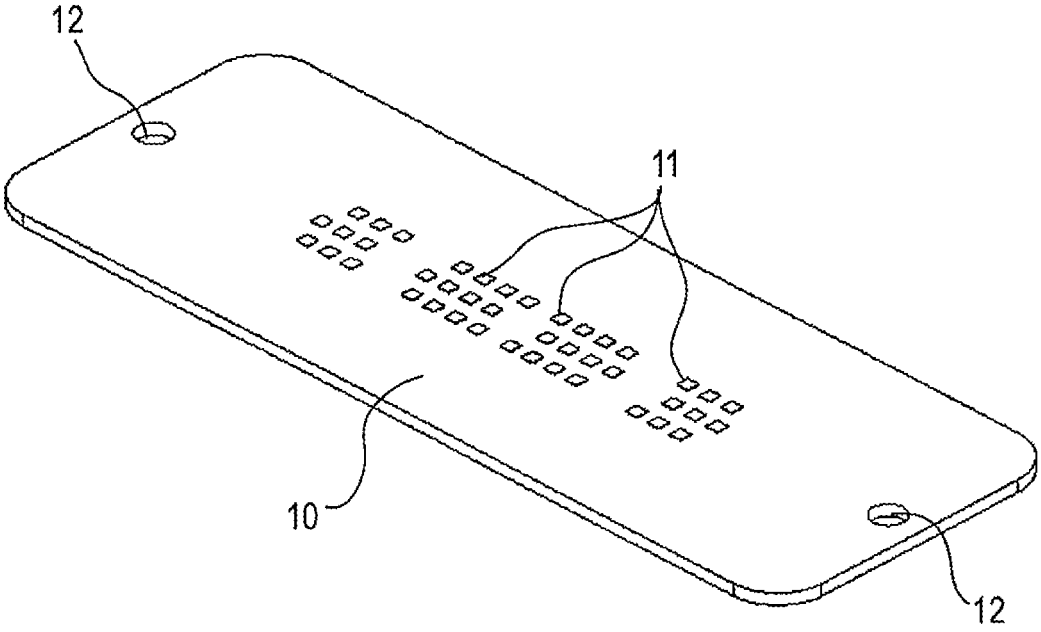
FIG. 2 is a perspective view of a circuit board shown in FIG. 1 when viewed from its front side.
Figure 3:
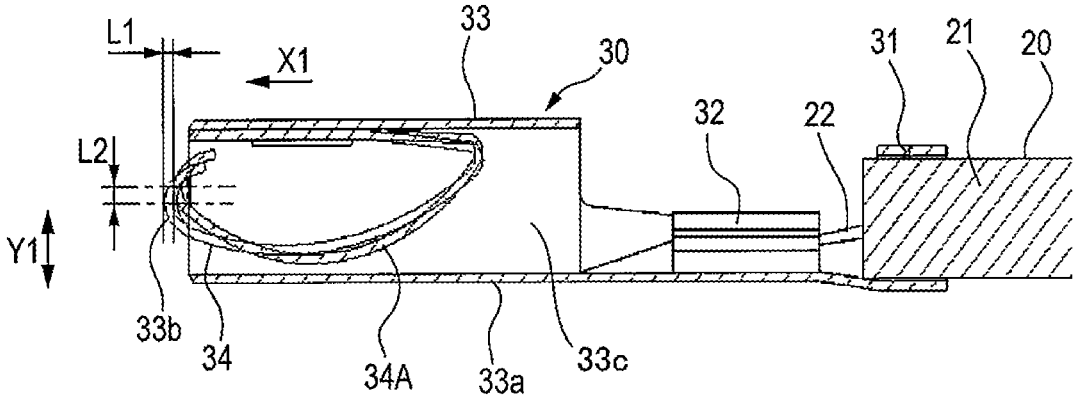
FIG. 3 is a longitudinal cross sectional view of terminal fitting shown in FIG. 1.
Figure 4:
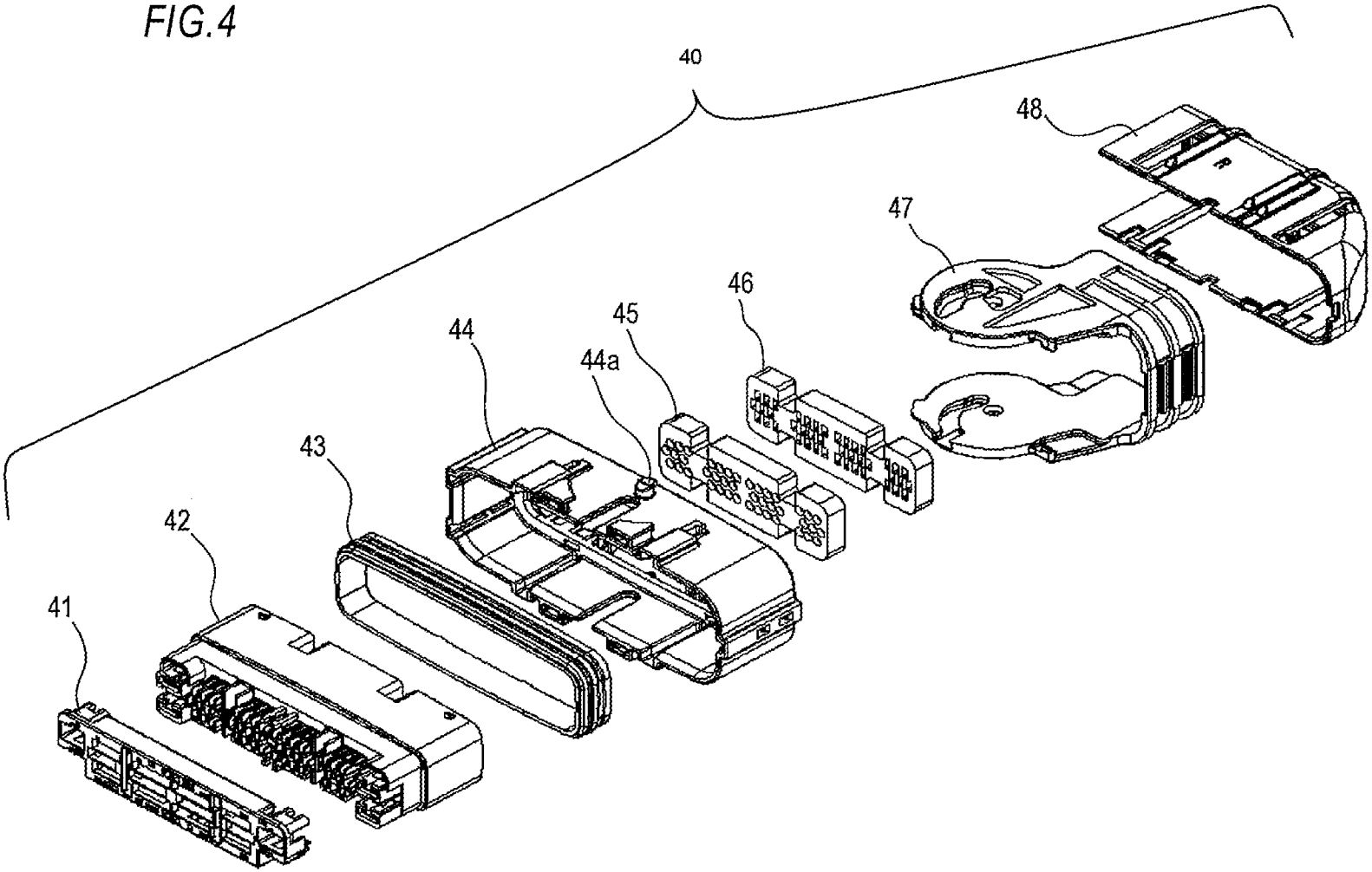
FIG. 4 is an exploded perspective view of a connector main body shown in FIG. 1.
Figure 5:
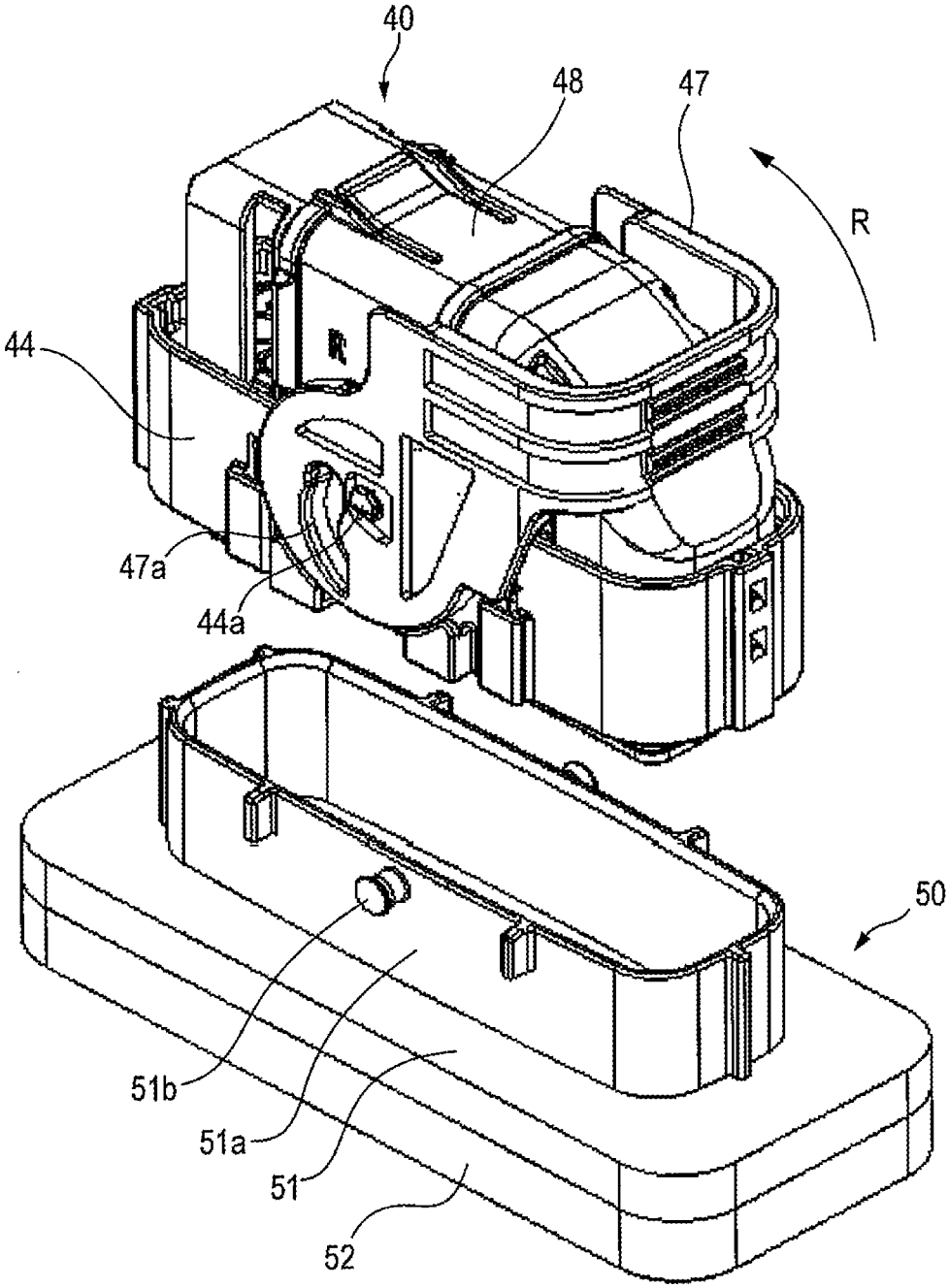
FIG. 5 is a perspective view of a connector receiving member and the connector main body of the embodiment acquired when they are oppositely placed.
Figure 6:
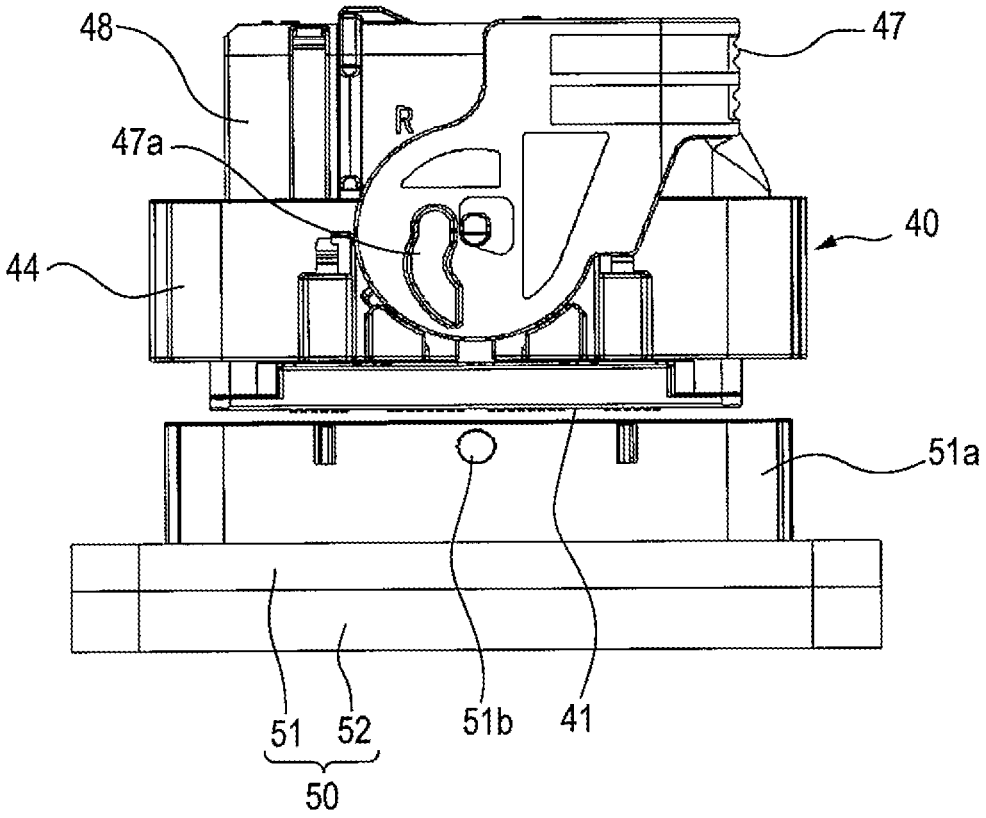
FIG. 6 is a side view of the connector receiving member and the connector main body which are shown in FIG. 5.
Figure 7:
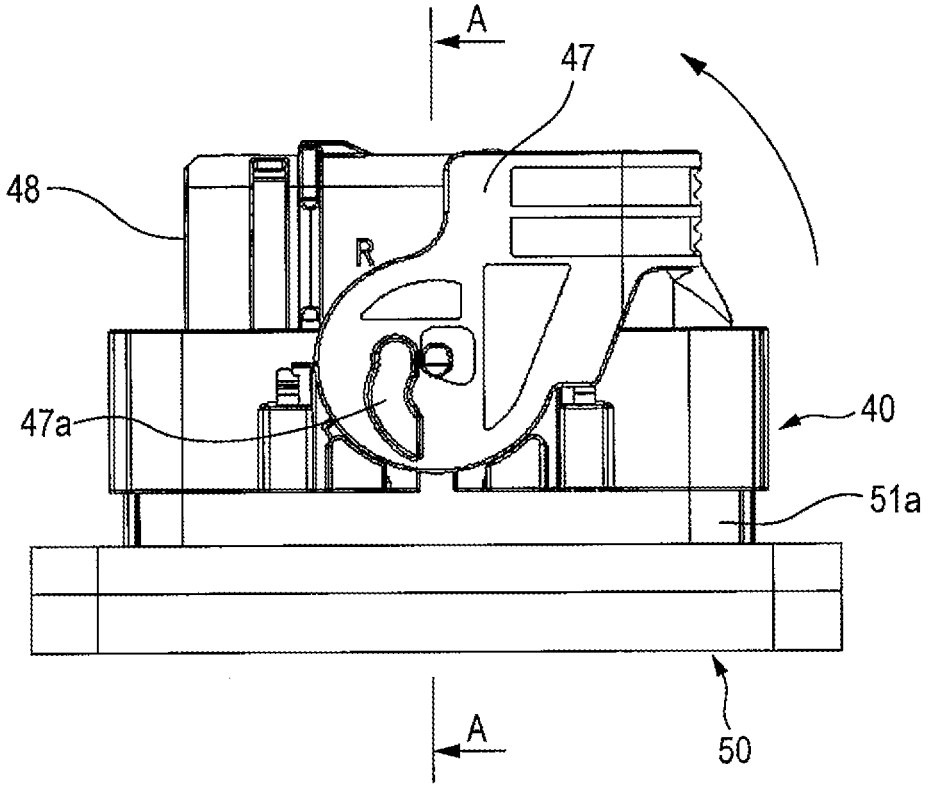
FIG. 7 is a side view showing that the connector receiving member and the connector main body, which are shown in FIG. 6, confront each other at a fitting start position.
Figure 8:
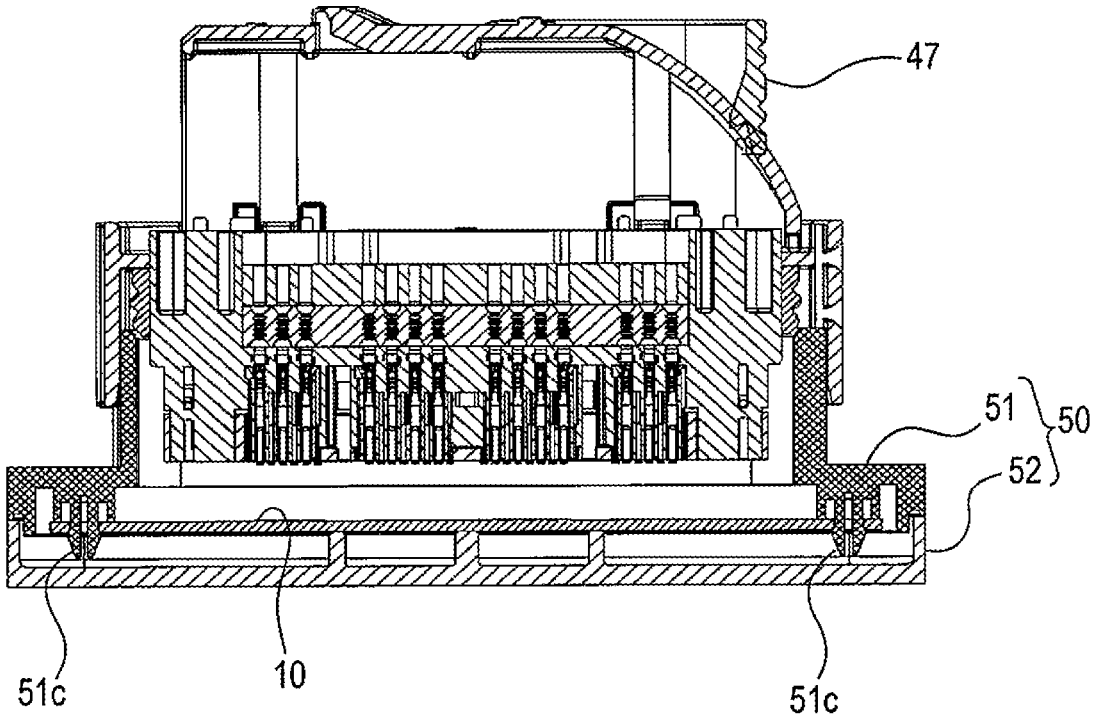
FIG. 8 is a longitudinal cross sectional view of the substrate connector shown in FIG. 7.
Figure 9:
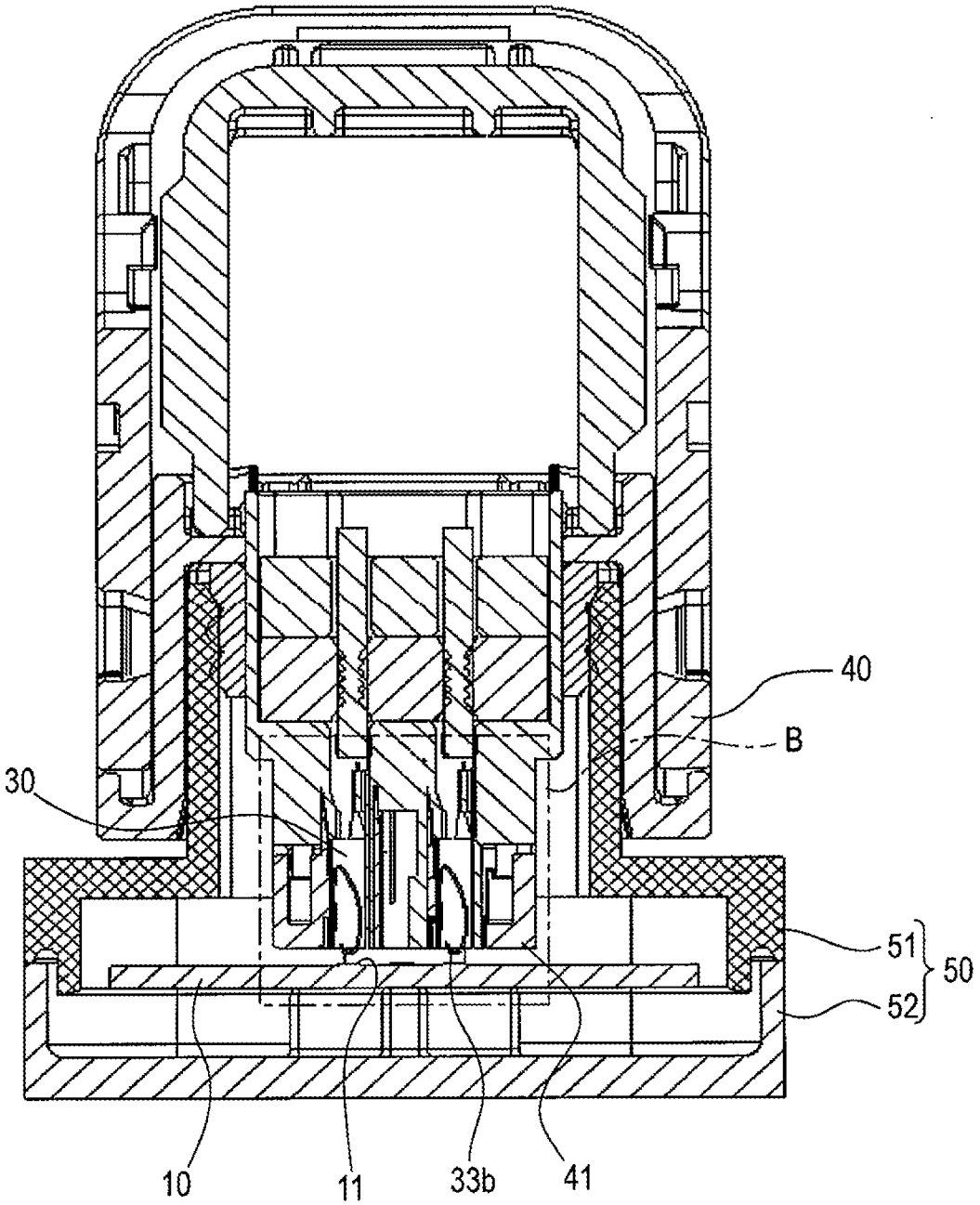
FIG. 9 is a cross section taken along line A-A shown in FIG. 7.
Figure 10:
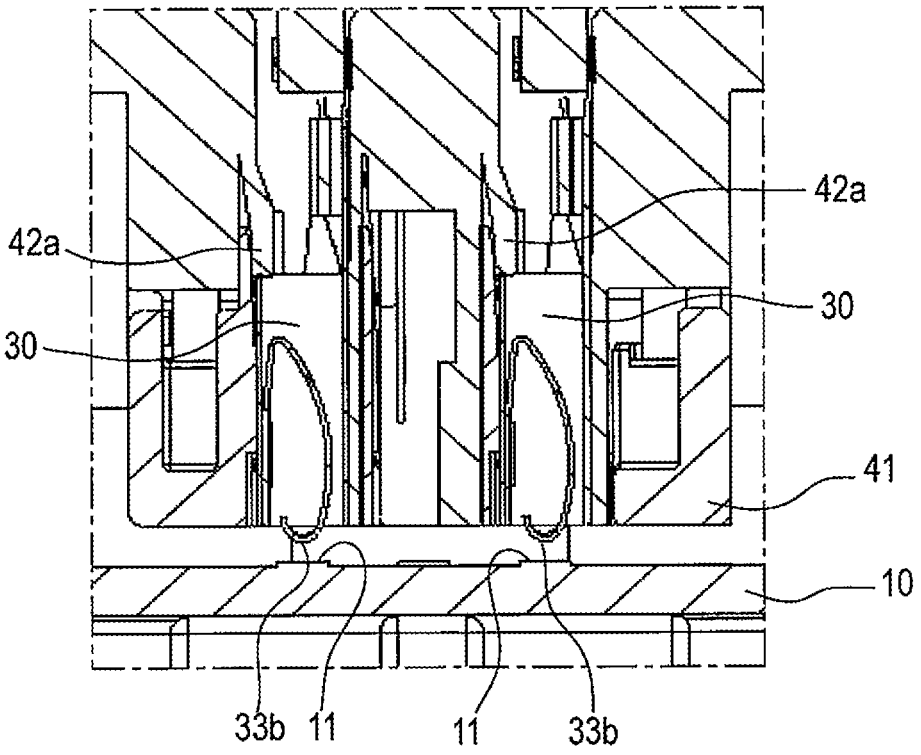
FIG. 10 is an enlarged view of area B shown in FIG. 9.
Figure 11:
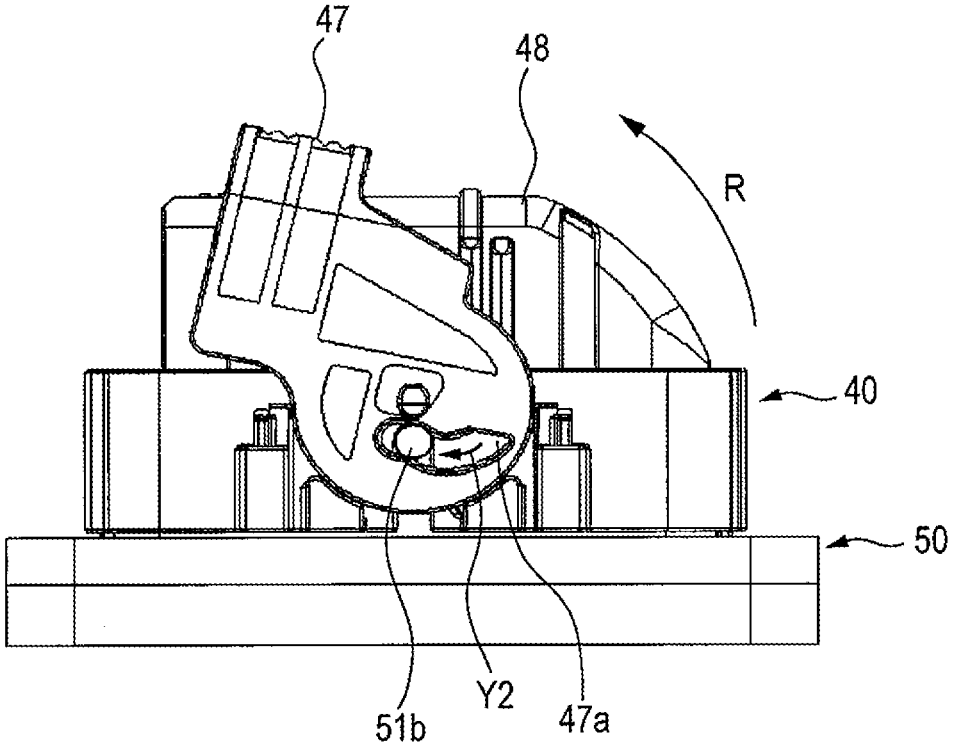
FIG. 11 is a side view showing that the connector receiving member and the connector main body are in the middle of fitting themselves by turning a fitting control lever.
Figure 12:
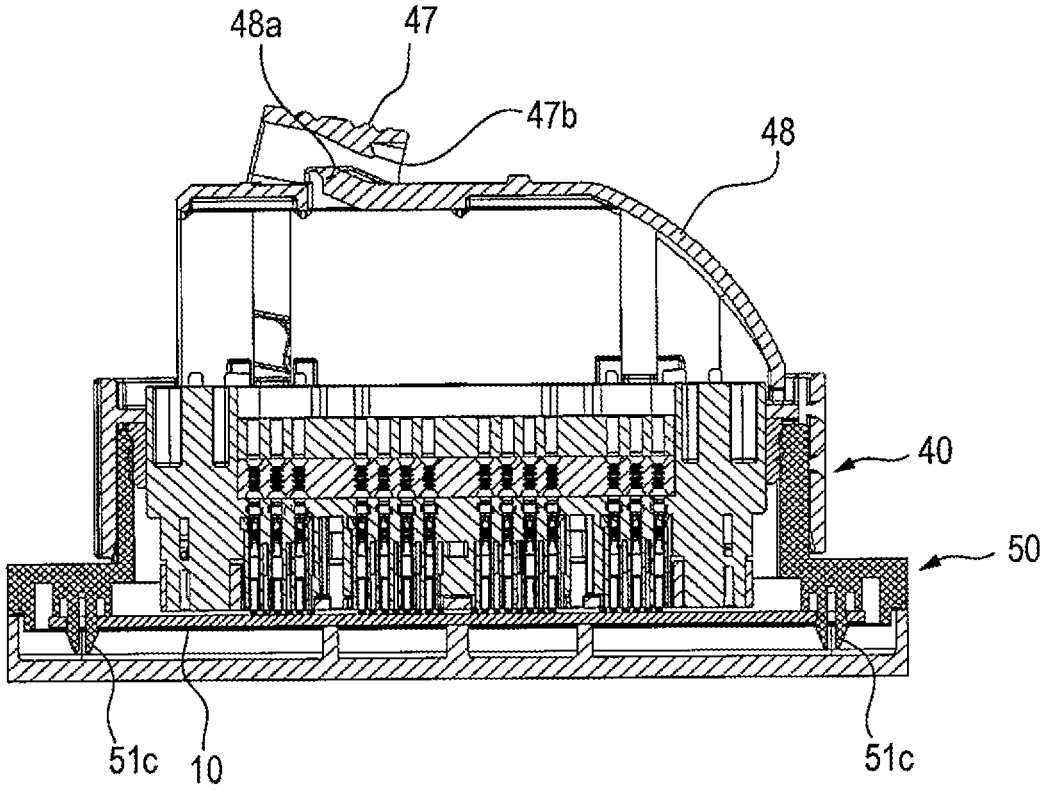
FIG. 12 is a longitudinal cross sectional view of the substrate connector shown in FIG. 11.
Figure 13:
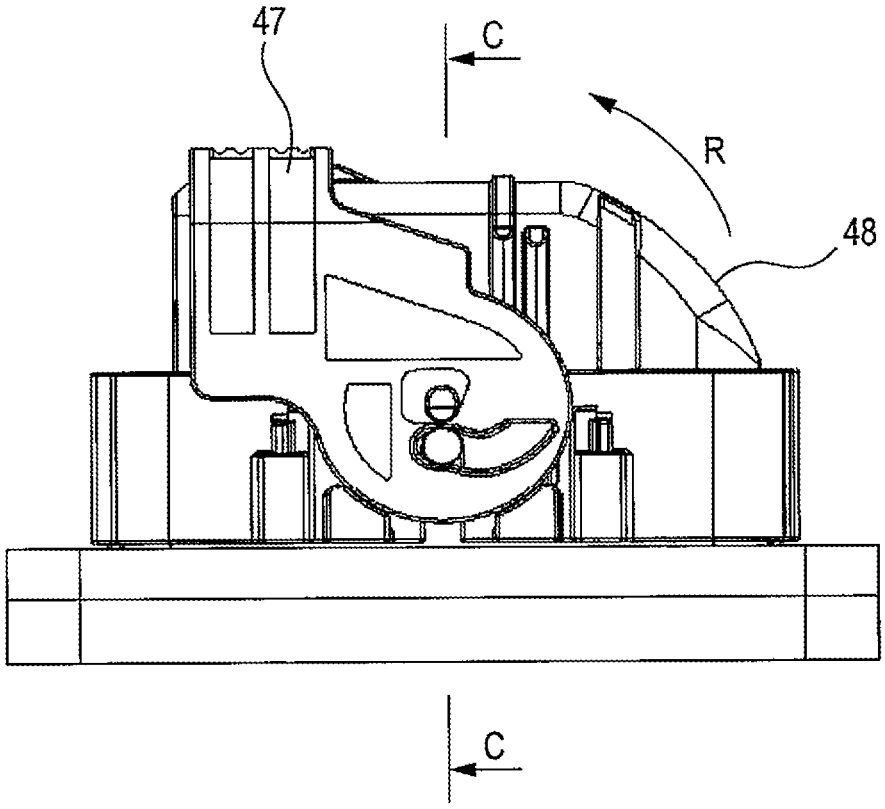
FIG. 13 is a side view showing that the connector receiving member and the connector main body have finished fitting themselves by turning the fitting control lever.
Figure 14:
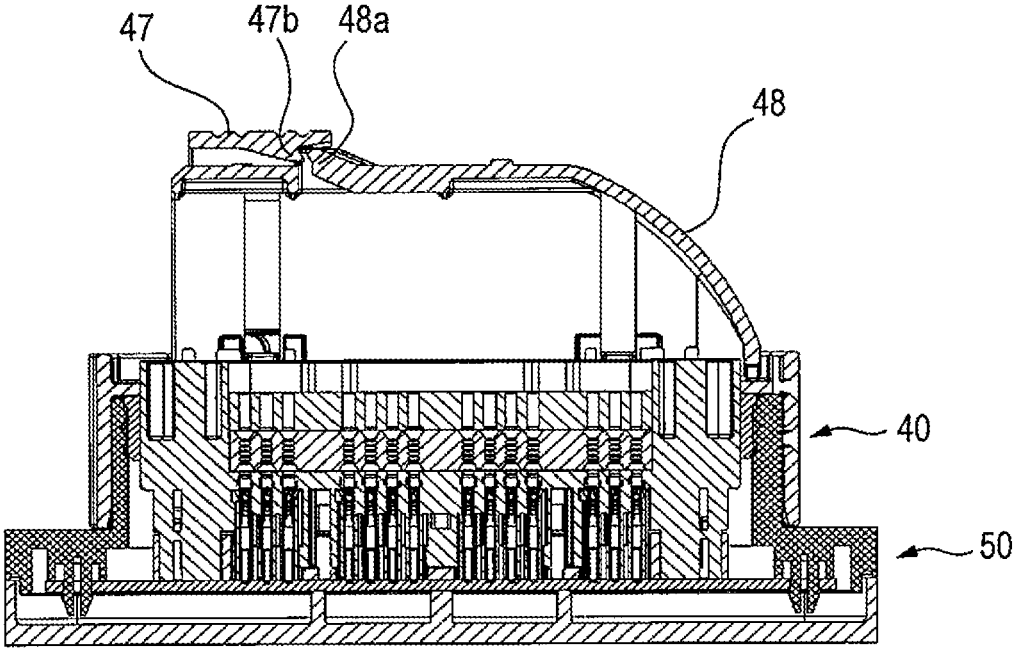
FIG. 14 is a longitudinal cross sectional view of the substrate connector shown in FIG. 13.
Figure 15:
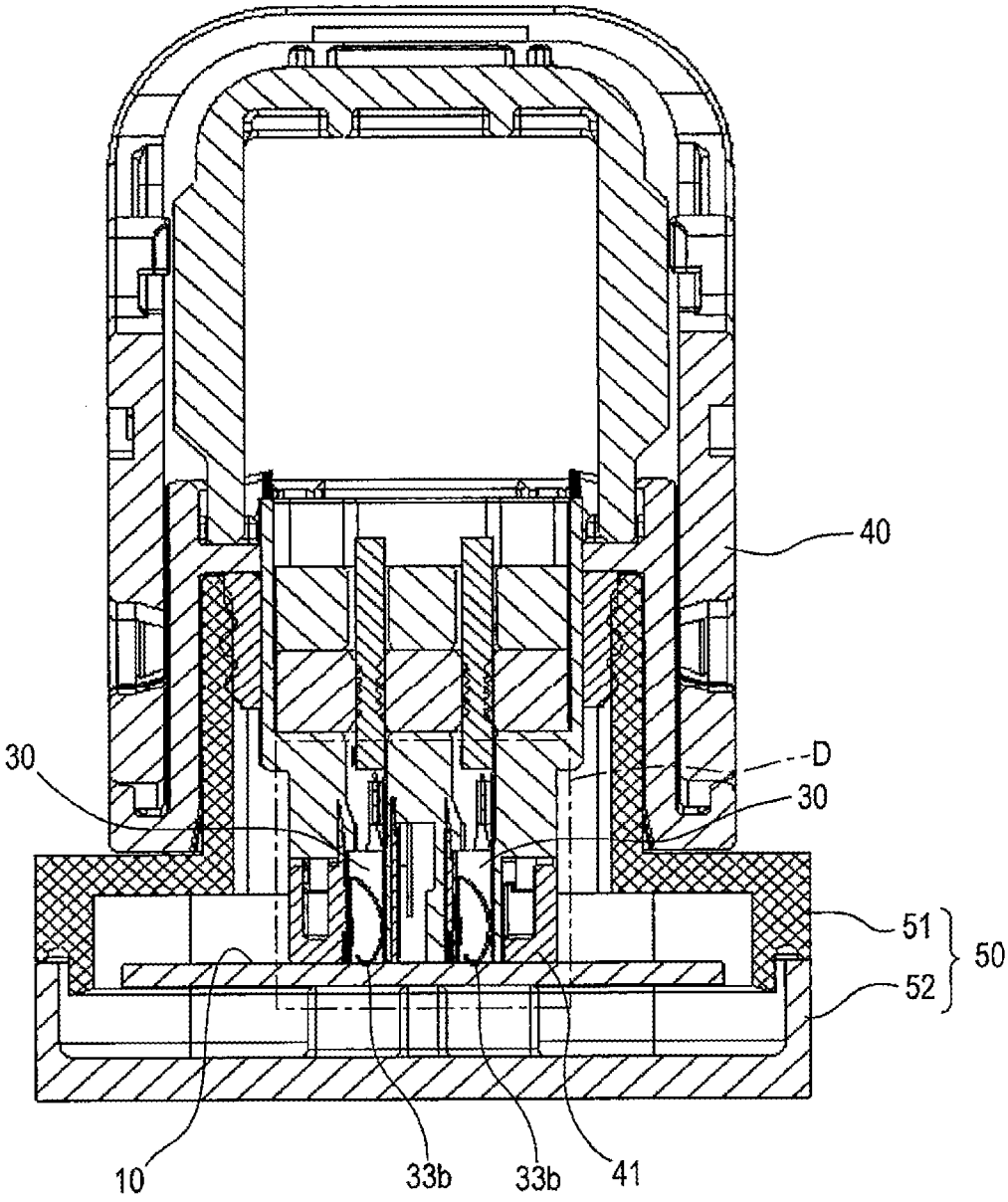
FIG. 15 is a cross section taken along line C-C shown in FIG. 13.
Figure 16:
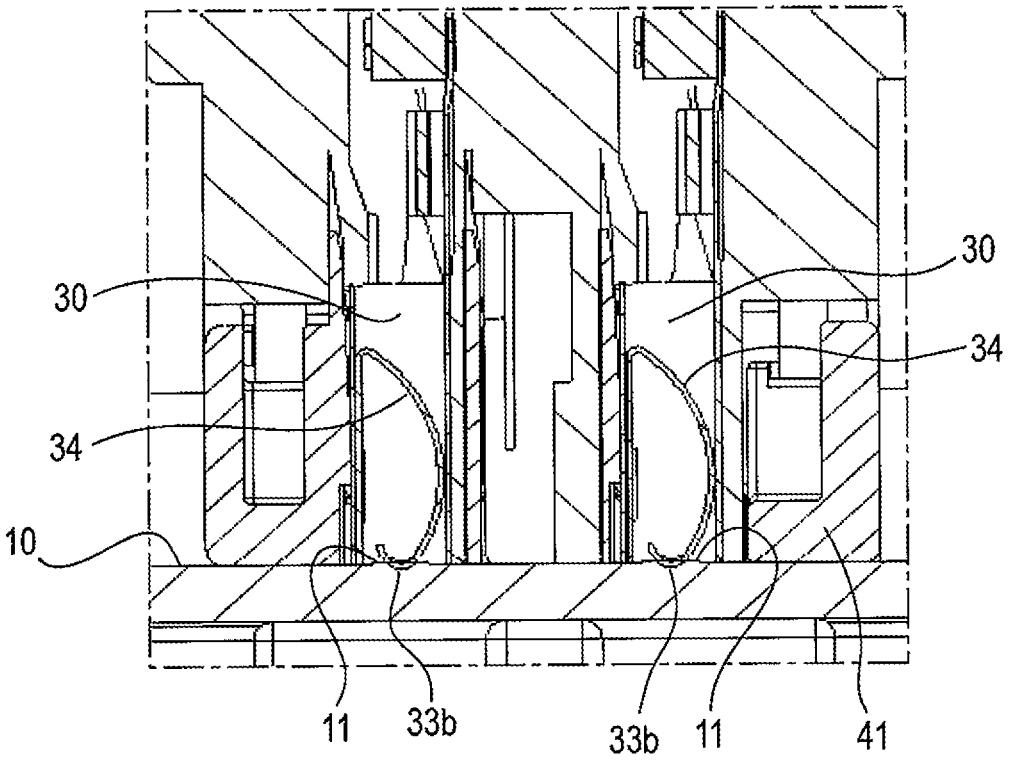
FIG. 16 is an enlarged view of area D shown in FIG. 15.
Figure 17:
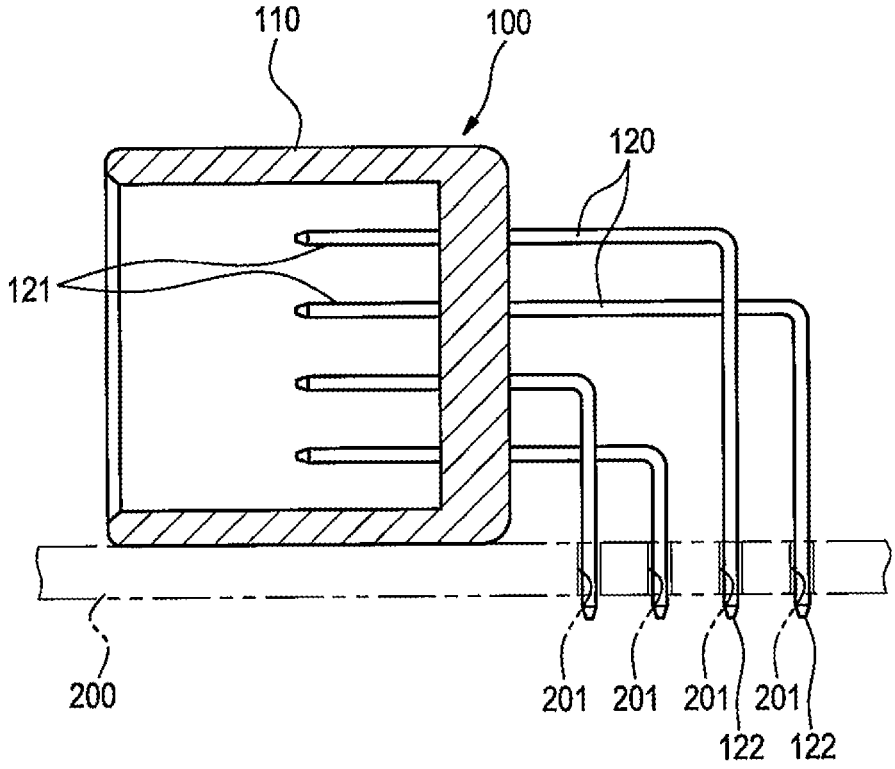
FIG. 17 is a longitudinal cross sectional view of a related art substrate connector.

FIGS. 1 through 16 show an embodiment of a substrate connector of the present invention. FIG. 1 is an exploded perspective view of the substrate connector of the embodiment of the present invention; FIG. 2 is a perspective view of a circuit board shown in FIG. 1 when viewed from its front side; FIG. 3 is a longitudinal cross sectional view of terminal fitting shown in FIG. 1; FIG. 4 is an exploded perspective view of a connector main body shown in FIG. 1; FIG. 5 is a perspective view of a connector receiving member and the connector main body of the embodiment acquired when they are oppositely placed; FIG. 6 is a side view of the connector receiving member and the connector main body which are shown in FIG. 5; FIG. 7 is a side view showing that the connector receiving member and the connector main body, which are shown in FIG. 6, confront each other at a fitting start position; FIG. 8 is a longitudinal cross sectional view of the substrate connector shown in FIG. 7; FIG. 9 is a cross section taken along line A-A shown in FIG. 7; FIG. 10 is an enlarged view of area B shown in FIG. 9; FIG. 11 is a side view showing that the connector receiving member and the connector main body are in the middle of fitting themselves by turning a fitting control lever; FIG. 12 is a longitudinal cross sectional view of the substrate connector shown in FIG. 11; FIG. 13 is a side view showing that the connector receiving member and the connector main body have finished fitting themselves by turning the fitting control lever; FIG. 14 is a longitudinal cross sectional view of the substrate connector shown in FIG. 13; FIG. 15 is a cross section taken along line C-C shown in FIG. 13; and FIG. 16 is an enlarged view of area D shown in FIG. 15.

As shown in FIGS. 1 through 3, a substrate connector 1 of the embodiment is a connector for conductively connecting a plurality of pieces of terminal fitting 30, which is connected to a cable 20 from external device, with a plurality of contact point patterns 11 arrayed on a circuit board 10 at a predetermined array pitch.

The circuit board 10 to which the substrate connector 1 of the embodiment is connected is a multilayer circuit board, and a circuit pattern and an electronic circuit are fabricated in an intermediate layer of the circuit board. Moreover, as shown in FIG. 2, the plurality of contact point patterns 11 are arrayed at a predetermined array pitch on one side of the circuit board. Further, a mount hole 12 used for attaching the circuit board 10 to a receiving member main body 51 to be descried later which is used for fittingly connecting the substrate connector 1 is formed on either side of an area where the plurality of contact point patterns 11 are put.

The terminal fitting 30 to be connected to the cable 20 from an external device is an article formed by press-molding a metallic plate. As shown in FIGS. 1 and 3, the terminal fitting 30 has a sheath fixing piece 31 crimped to a sheath 21 of the cable 20, a conductor crimping piece 32 crimped to a conductor 22 of the cable 20, and a box 33 for connection with the contact point pattern 11.

The box 33 is equipped with contact points 33*b* that are placed in a protruding fashion at a leading end of a terminal main body 33*a* which is made by forming a metallic plate into the shape of an angular tube. The contact points 33*b* are conductively connected to corresponding contact point patterns 11 as a result of a leading end face of the contact point being brought into contact with the contact point pattern 11. In the case of the embodiment, the contact points 33*b* are provided by spring pieces 34 that experience predetermined elastic deformation when contacting corresponding contact point patterns 11, so as to generate a predetermined contact pressure against the contact point patterns 11.

The individual spring piece 34 is placed between a pair of sidewalls 33*c* and 33*c* such that a portion of the spring piece 34 projects from the leading end of the terminal main body 33*a*. The individual spring piece 34 is formed integrally on the terminal main body 33*a* by folding a strip-shaped plate piece continued from the one sidewall 33*c* of the terminal main body 33*a* such that a portion of the plate piece projects from the leading end of the terminal main body 33*a*. A leading end of a portion of the individual spring piece 34 that projects from the leading end of the terminal main body 33*a* is served as the contact point 33*b*. As shown in FIG. 3, a portion of the individual spring piece 34 situated in the terminal main body 33*a* is served as a spring for elastically displacing the corresponding contact point 33*b* in a direction opposite to the projecting direction.

When elastically deformed upon contact with the contact point pattern 11, the contact points 33*b* of the embodiment become elastically displaced by only a distance L1 with respect to a contacting direction of the contact point pattern 11 (a direction of arrow X1 in FIG. 3), thereby generating predetermined contact pressure necessary for an electrical connection. Moreover, a bend shape of the individual spring piece 34 is set such that, when elastically deformed upon contact with the contact point pattern 11, the individual contact point 33*b* is elastically displaced by only a distance L2 along a plane direction of the contact point pattern 11 (i.e., a direction of arrow Y1 in FIG. 3) so as to slide over a surface of the corresponding contact point pattern 11.

In FIG. 3, a diagonally-shaded spring piece 34A shows a state in which the spring piece 34 becomes elastically deformed as a result of a leading end face of the contact point 33*b* contacting the contact point pattern 11.

The substrate connector 1 of the embodiment has a connector main body 40 that houses and retains the pieces of terminal fitting 30 at an array pitch corresponding to an array pitch at which the contact point patterns 11 are put on the circuit board 10, as well as having a connector receiving member 50 to be attached to the circuit board 10.

As shown in FIG. 4, the connector main body 40 is made up of a front holder 41, an inner housing 42, a packing 43, an outer housing 44, a mat seal 45, a mat seal cover 46, a fitting control lever 47, and a back cover 48. Thus, the pieces of terminal fitting 30 are housed and retained at the array pitch corresponding to the array pitch of the contact point patterns 11. The connector main body 40 positions a leading end of each of the pieces of housed terminal fitting 30 by the front holder 41 and a retaining lance 42*a* in the inner housing 42 (see FIG. 10). When, by positioning, a leading end face of the connector main body 40 is butted against the surface of the circuit board 10 on which the contact point patterns 11 are placed in order, the leading end face (the contact point 33*b*) of each of the housed and retained pieces of terminal fitting 30 comes into contact with the corresponding contact point pattern 11.

As also shown in FIG. 5, the fitting control lever 47 provided on the connector main body 40 is attached, in a turnable fashion, to a lever support shaft 44*a* provided in a projecting manner on either side of the outer housing 44. A cam groove 47*a* that comes into engagement with a boss 51*b* of the connector receiving member 50 to be described later is formed on the fitting control lever 47. In connection with the fitting control lever 47, as shown in FIG. 7, when the connector main body 40 and the connector receiving member 50 to be described later are aligned to a fitting start position, the boss 51*b* provided on the connector receiving member 50 comes into engagement with a starting end of the cam groove 47*a*. Further, as shown in FIGS. 11 through 14, when the fitting control lever 47 is turned and manipulated in a predetermined direction (in direction R shown in FIGS. 11 and 13), the cam groove 47*a* draws the boss 51*b* of the connector receiving member 50 along the fitting direction of the connector main body 40, thereby causing the connector main body 40 to fit to the connector receiving member 50 and consequently bringing the connector main body 40 and the connector receiving member into connection with each other.

The back cover 48 provided on the connector main body 40 is joined to a rear portion of the outer housing 44 and regulates the drawing direction of the cable 20 housed in the connector main body 40.

The connector receiving member 50 is a member that holds the leading end face of the connector main body 40 butted against a surface of the circuit board 10 and that is previously mounted on the circuit board 10.

As shown in FIG. 1, the connector receiving member 50 of the embodiment has the receiving member main body 51 to be attached to the front side of the circuit board 10, and a back cover 52 to be attached to the receiving member main body 51 so as to cover the back side of the circuit board 10.

As shown in FIG. 5, the receiving member main body 51 has a tubular section (hood) 51*a* to which the connector main body 40 fits, the bosses 51*b* provided projectingly on an exterior surface of the tubular section 51*a*, and substrate engagement sections 51*c* that are fitted into the mount holes 12 of the circuit board 10, to thus connect to the circuit board 10.

The bosses 51*b* projectingly provided on the exterior surface of the tubular section 51*a* of the receiving member main body 51 come into engagement with the cam groove 47*a* of the fitting control lever 47 when the connector main body 40 starts going into the receiving member main body 51. The bosses 51*b* are drawn toward the connector main body 40 by turning operation of the fitting control lever 47, thereby bringing the connector receiving member 50 into connection with the connector main body 40.

Next, by reference to FIGS. 6 through 16, explanations are given to procedures employed when the pieces of terminal fitting 30 connected to the cable 20 from the external device are conductively connected to the contact point patterns 11 on the circuit board 10.

The connector receiving member 50 is previously attached to the circuit board 10. The pieces of terminal fitting 30 are previously retained in the connector main body 40.

First, as shown in FIG. 6, the leading end face of the connector main body 40 is placed opposite the tubular section 51*a* of the connector receiving member 50.

Next, as shown in FIGS. 7 and 8, the connector main body 40 is caused to butt against the connector receiving member 50, and they are respectively aligned to the fitting start position. In a state in which the connector receiving member 50 and the connector main body 40 are aligned to the fitting start position, the bosses 51*b* provided on the receiving member main body 51 remain in engagement with the leading end of the cam groove 47*a* in the fitting control lever 47. As shown in FIGS. 9 and 10, the front end face of the connector main body 40 is spaced apart from the surface of the circuit board 10, and the contact points 33*b* of the pieces of the terminal fitting 30 remain out of contact with the contact point patterns 11.

As shown in FIGS. 11 and 12, the fitting control lever 47 is now turned, whereupon the cam groove 47*a* of the fitting control lever 47 draws the bosses 51*b* of the receiving member main body 51 in direction of arrow Y2 shown in FIG. 11 along with turning action of the fitting control lever 47, whereby the connector main body 40 and the connector receiving member 50 are brought into deeper engagement.

FIGS. 11 and 12 show that the fitting control lever 47 is in the middle of turning action and that the connector main body 40 and the connector receiving member 50 have not yet finished engagement.

As shown in FIGS. 13 and 14, when the fitting control lever 47 is turned to an end of a turning range, the connector main body 40 and the connector receiving member 50 finish fitting to each other. When fitting the connector main body 40 to the connector receiving member 50 is completed, a lever latch projection 48*a* provided on the back cover 48, as shown in FIG. 14, comes into engagement with a lock step 47*b* formed on an opposite surface on the fitting control lever 47, thereby regulating returning action of the fitting control lever 47. Thus, the connector main body 40 and the connector receiving member 50, which remain in connection with each other, are locked.

When the connection of the connector main body 40 with the connector receiving member 50 is locked, the leading end face of the connector main body 40, as shown in FIGS. 15 and 16, comes into contact with the front side of the contact point patterns 11. Further, the contact points 33*b* of the pieces of terminal fitting 30 retained by the connector main body 40 come into contact with the contact point patterns 11 while remaining elastically deformed and compressed, whereupon the terminal fitting 30 and the contact point patterns 11 come into a state of conductive connection.

In the substrate connector 1 of the embodiment described thus far, a conductive connection of the terminal fitting 30 connected to the cable 20 from the external device with the contact point patterns 11 on the circuit board 10 is realized by connecting the connector main body 40 to the connector receiving member 50 on the circuit board 10 and butting the leading end face of the connector main body 40 against the surface of the circuit board 10, thereby bringing the leading end faces of the pieces of the terminal fitting 30 retained by the connector main body 40 into contact with the contact point patterns 11 on the circuit board 10. Therefore, when the cable 20 from the external device is conductively connected to the contact point patterns 11 of the circuit board 10, laborious work for soldering the circuit board 10 becomes unnecessary.

In addition, conductively connecting the terminal fitting 30 connected to the cable 20 from the external device with the contact point patterns 11 on the circuit board 10 is carried out by a mutual butt contact, and mating the pieces of terminal fitting 30 to each other, which would otherwise cause a collision or prying during connection, is not performed. For these reasons, there is no potential risk of causing breakage of the terminal fitting 30, which might be caused by a collision or prying action during connection.

Accordingly, the terminal fitting 30 connected to the cable 20 from the external device can be easily brought into a conductive connection with the contact point patterns 11 on the circuit board 10.

The terminal fitting 30 is provided by the spring pieces 34 that impart predetermined contact pressure to the contact point patterns 11 as a result of the contact points 33*b*, which contact the contact point patterns 11, experiencing predetermined elastic deformation upon contact with the corresponding contact point patterns 11. Therefore, a stable state of electrical connection can be assured without being affected by dimensional and assembly errors in the connector main body 40, and reliability of a connection between the contact point patterns 11 and the terminal fitting 30 can be improved.

In the substrate connector 1 of the embodiment that has been described above, when contacting the corresponding contact point patterns 11 of the circuit board 10, the contact points 33*b* of the terminal fitting 30 slide over the surfaces of the respective contact point patterns 11 in the course of elastic displacement, thereby performing wiping action effective for removing an oxide coating film from each of the contact surfaces of both the contact point patterns and the contact points. Therefore, a drop in electrical connection characteristic, which would otherwise be caused by the oxide coating film, can be prevented.

The substrate connector 1 of the embodiment that has been described above can easily provide the terminal fitting 30 having the contact points 33*b* that are elastically displaced, without involvement of an increase in the number of parts.

Further, in the substrate connector 1 of the embodiment that has been described above, a connection of the connector main body 40 with the connector receiving member 50 can be easily implemented by turning operation of the fitting control lever 47, thereby making easy work for coupling the connector main body 40 with the connector receiving member 50.

The present invention is not limited to the embodiment and is susceptible to deformation, improvement, and others, when necessary. In addition, materials, shapes, dimensions, the number, and locations of the respective constituent elements described in connection with the embodiment are arbitrary and not limited, so long as the present invention can be accomplished.

For instance, the embodiment mentions the form in which the circuit board 10 is housed in the connector receiving member 50. However, the size of the circuit board 10 is not limited to the embodiment. For instance, another conceivable form is that the circuit board 10 is larger than the connector receiving member 50 and that the plurality of substrate connectors 1 are connected to one circuit board 10.

The specific structure of the connector receiving member to be attached to the circuit board is not limited to the structure described in connection with the embodiment, either. For instance, the connector receiving member can also assume a structure from which the back cover 52 is omitted.

In the embodiment, the fitting control lever that is provided in the connector main body in a turnable manner is utilized for connecting the connector main body with the connector receiving member. However, there can also be adopted another configuration that does not use the fitting control lever and that brings lock protrusions provided on the connector main body into engagement with engagement sections provided on the connector receiving member, to thereby bring the connector main body into connection with the connector receiving member.

In the substrate connector of the present invention, the number of pieces of terminal fitting retained and housed in the connector main body can be single or plural and set to an arbitrary number as needed.

In the substrate connector of the present invention, a conductive connection of the terminal fitting connected to the cable from the external device with the contact point patterns on the circuit board is realized by connecting the connector main body to the connector receiving member on the circuit board and butting the leading end face of the connector main body against the surface of the circuit board, thereby bringing the leading end faces of the pieces of the terminal fitting retained by the connector main body into contact with the contact point patterns on the circuit board. Therefore, when the cable from the external device is conductively connected to the contact point patterns of the circuit board, laborious work for soldering the circuit board becomes unnecessary.

What is claimed is:

1. A substrate connector that conductively connects a terminal fitting connected to a cable from an external device with contact point patterns arrayed at a predetermined array pitch on one side of a circuit board, the connector comprising:

a connector main body that houses and retains pieces of the terminal fitting at an array pitch corresponding to the array pitch of the contact point patterns and having a leading end face butted against a surface of the circuit board on which the contact point patterns are arrayed, so as to bring leading end faces of the pieces of the terminal fitting with the contact point patterns; and a connector receiving member that is attached to the circuit board and that holds the leading end face of the connector main body butted against the surface of the circuit board;

wherein the terminal fitting is provided with a spring piece that imparts a predetermined contact pressure to the contact point patterns by a predetermined elastic deformation upon contact with the corresponding contact point patterns and served as contact points to be contacted with the contact point patterns, and the spring piece is formed integrally on the terminal main body by folding a strip-shaped plate piece continued from the one sidewall of the terminal main body such that a portion of the plate piece projects from the leading end of the terminal main body.

2. The substrate connector according to claim 1, wherein, when elastically deformed upon contact with the contact point patterns, the contact points of the terminal fitting are elastically displaced along a planar direction of the contact point patterns so as to slide over surfaces of the contact point patterns.

3. The substrate connector according to claim 1, wherein the spring piece is placed between a pair of sidewalls of the terminal fitting such that a portion of the spring piece projects from the leading end of the terminal main body;

a leading end of the portion of the spring piece that projects from the leading end of the terminal main body is served as the contact point; and a portion of the spring piece situated in the terminal main body is served as a spring for elastically displacing the corresponding contact point in a direction opposite to a projecting direction.

4. The substrate connector according to claim 1, wherein the connector receiving member has a tubular section to which the connector main body fits and a boss provided projectingly on an exterior surface of the tubular section, and wherein the connector main body includes a fitting control lever attached so as to be turnable and a cam groove that is formed in the fitting control lever and that draws the boss in a fitting direction of the connector main body by turning action of the fitting control lever, so as to connect the connector main body to the connector receiving member.

* * * * *